33-233 SR
10/14/86 OR 4,616,421

United States Patent [19]

Forsén

[11] Patent Number: 4,616,421

[45] Date of Patent: Oct. 14, 1986

[54] SIGHT MEANS

[75] Inventor: Ivan Forsén, Örnsköldsvik, Sweden

[73] Assignee: Inogon Licens AB, Sjalevad, Sweden

[21] Appl. No.: 739,386

[22] Filed: May 30, 1985

[30] Foreign Application Priority Data

Jun. 7, 1984 [SE] Sweden ..... 8403082

[51] Int. Cl.[4] ..... F41G 3/00

[52] U.S. Cl. ..... 33/233; 33/242; 33/243

[58] Field of Search ..... 33/233, 241, 242, 243, 33/245

[56] References Cited

U.S. PATENT DOCUMENTS

| | | | |
|---|---|---|---|
| 2,420,273 | 5/1947 | West | 33/233 |
| 2,498,706 | 2/1950 | Pease et al. | 33/242 |
| 4,458,436 | 7/1984 | Bohl | 33/233 |

FOREIGN PATENT DOCUMENTS

| | | | |
|---|---|---|---|
| 1100510 | 2/1961 | Fed. Rep. of Germany | 33/233 |

*Primary Examiner*—Willis Little
*Attorney, Agent, or Firm*—Nies, Webner, Kurz & Bergert

[57] ABSTRACT

A sight means, particularly for weapons and other objects which are intended to be sighted onto a given point, comprises two mutually spaced and two mutually parallel grid discs (3,4) each of which includes a transparent disc provided with concentrically lying opaque grid lines separated by transparent interspaces, and which grid discs (3,4) are arranged in a tubular housing (2). In accordance with the invention a central region (7,8) is devoid of opaque lines in the center of the discs (3,4) this region having a size of approximately 1/5 to ½ of the disc diameter, or a corresponding measurement, the target being intended to be viewed through the aforesaid regions.

In accordance with one embodiment one (3;4) of the grid discs has solely one more opaque line than the other (4;3) of the grid disc in the region provided with grid lines.

9 Claims, 13 Drawing Figures

SIGHT MEANS

BACKGROUND OF THE INVENTION

The present invention relates to sight means, primarily weapon sighting means, and in particular to sight means for handguns and small firing arms, such as different types of rifle. The sight means, however, can be used with all weapons and also in other contexts where there is a need to sight an object onto a given point.

A common sight means in the case of rifles is a so-called open sight comprising a grooved backsight and a bead foresight. Another commonly used sight means is the so-called diopter sight comprising a diopter and a bead-ring foresight, in which various types of sighting beads can be mounted. Various types of telescopic sight are also available.

A diopter sight has the advantage of being extremely accurate. When aligning the sights onto the target, the bead is brought to bear thereon while at the same time bringing the bead ring and the diopter ring concentrical with one another, so as to form a light annulus. When using a diopter sight, the marksman sees only a relatively limited part of the target surroundings.

Telescopic sights are also highly accurate, although here again the marksman sees only a relatively small part of the target surroundings.

SUMMARY OF THE INVENTION

The present invention relates to a new type of sight which allows a weapon or some other pertinent object to be aligned with the target with extreme accuracy, while enabling the marksman or a corresponding person to see far more of the target surroundings than can be seen when viewing the target through known sighting means.

Thus, the present invention relates to a sight means particularly intended for such we and objects as those which shall be brought into alignment with a given point, comprising two mutually spaced and mutually parallel grid discs, of which each disc includes a transparent disc provided with concentrically lying opaque grid lines separated by transparent interspaces, said grid discs being arranged in a tubular housing, the sight means being characterized in that the discs have located in the centres thereof a central region which is devoid of opaque lines and which has a size corresponding approximately from 1/5 to ½ of the diameters of the grid discs, or a corresponding measurement, the target being viewed through said regions.

In Swedish Patent Specification No. 411,686, see corresponding U.S. Pat. No. 4,272,191, dated June 9, 1981 to Lars A. Berkqvist, there is described a device for giving an angle or a directional indication when laying pipes or the likes. This patent specification describes the arrangement of two mutually spaced grid discs provided with mutually concentric grid lines. The device is designed for use as an aligning instrument, i.e. an instrument which is intended to be viewed from a given distance, to enable an interference pattern to be viewed and evaluated by the viewer.

In accordance with the invention there is also used two grid discs having grid lines formed concentrically thereon.

The present invention is based on the concept that when using the inventive sight means, the viewer looks through the grid discs and aligns a central region of the discs onto the target. The sight means can be aligned onto the target with great accuracy, by utilizing the sensitivity of a moiré pattern.

It has namely been found that a person using the sight means according to the present invention will discern immediately when the target and the centres of the central regions of the discs lie along the same line, due to the fact that the eye readily detects the symmetry in the interference pattern formed, which is exemplified below. Thus, in the majority of applications sufficient accuracy can be obtained with the use of two grid discs with relatively small central regions. In other cases the central regions may be made somewhat larger, namely a size such that when sighting through the central regions there is obtained a target area corresponding to the target area normally obtained with telescopic sights. The sight means according to the invention includes herewith a sight of the cross-wire or bead type etc., placed forwardly of the grid discs or in direct connection with one of said discs, preferably the forwardly located disc, in line with the centres of said discs.

The invention makes it possible to choose the size of both the grid discs and the regions thereon devoid of grid lines. This enables various desiderata to be fulfilled with regard to the visibility radius afforded by the central regions devoid of grid lines.

Because it is also possible to see through those parts of the grid discs which are provided with grid lines, the total target area presented is much larger than that presented through a conventional diopter sight or telescopic sight.

Thus, the resultant interference pattern is discerned by the eye and is used to align the sight so that the interference pattern comprises concentric interference bands.

As beforementioned, when compared with known sights this will afford the important advantage of enabling a large part of the target surroundings to be viewed through the sight, while a high degree of accuracy can be obtained by selecting grids of different graduation.

Distinct from the device described in the aforecited Swedish and U.S. patents, the interference pattern strikes that part of the retina which lies outside the so-called yellow spot thereof, i.e. the interference pattern is discerned by the indirect vision when the sight, e.g. a bead and the target, is discerned by the direct vision.

The sight means according to the invention therefore affords the advantage of providing simultaneously a rough sighting, where the solid angle presented by the grid discs is viewed through the sight means, and a fine sighting, where the target is brought into line and the interference pattern is utilized to sight the weapon or said other object onto the target.

This makes the sight means according to the invention particularly useful for hunting purposes and for various kinds of competition shooting. When in its simplest form, in which it lacks a sighting bead or other form of sight, the sight means may be constructed for one-time use only, for sighting landmines for example onto a given target with a high degree of accuracy compared with conventional disposable sights.

BRIEF DESCRIPTION OF THE DRAWING

The invention will now be described in more detail with reference to an embodiment thereof illustrated in the accompanying drawings, in which.

DETAILED DESCRIPTION OF THE INVENTION

Figure 2:
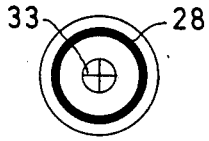
FIG. 2 illustrates the image seen by the marksman when the sight means is correctly sighted or aligned.
Figure 3:
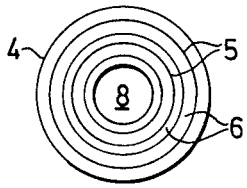
FIGS. 3 and 4 illustrate two grid discs according to a first embodiment.
Figure 4:
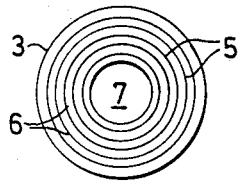
Figure 10:
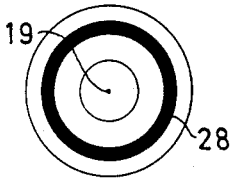
FIGS. 10–12 illustrate different interference patterns which occur with different sighting of the sight means using grids according to the second embodiment.

FIGS. 2 and 10 are similar illustrations, but with the difference that FIG. 10 is in larger scale and the embodiment of FIG. 2 also incorporates a cross-wire.

Figure 1:
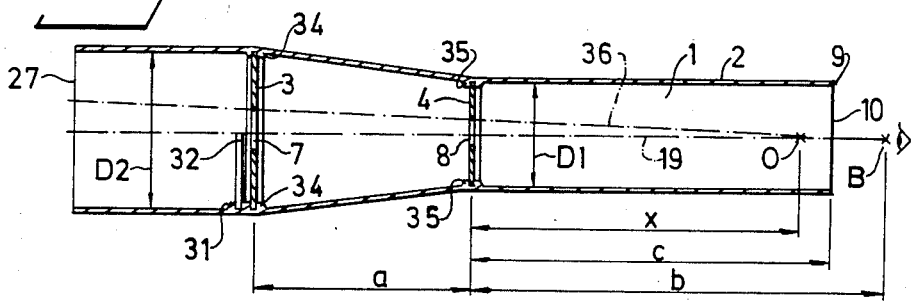
FIG. 1 is a longitudinal sectional view of a sight means according to the invention.

FIG. 1 illustrates a sight means 1 according to one embodiment of the invention. The illustrative sight means comprises a tubular housing 2 and two mutually spaced and mutually parallel grid discs 3,4. Each of the grid discs 3,4 comprises a transparent disc provided with concentrically lying opaque lines 5 separated by transparent interspaces 6.

Located in the centres of respective discs is a central region 7,8 which is equal in size to from 1/5 to ½ of the diameter of said discs, or a corresponding measurement, the target being viewed through these regions. According to one embodiment, the regions 7,8 are transparent. According to another embodiment each of the regions 7,8 comprises an aperture or window.

According to a further, preferred embodiment each of the grid discs is provided with an aperture in the centre of the circular transparent regions 7,8.

The central region is preferably circular and consequently a circular region 7,8 is given in the present description as an exemplifying embodiment. It will be understood, however, that the central region can have a shape other than circular. For example, said central region may have a square or an elongated rectangular shape, although a circular shape is preferred. Similarly, the aforesaid apertures and the grid discs in general may also have a shape other than circular.

The diameters of the central regions 7,8, and optionally also the apertures in the central regions, are such that an imaginary straight line 36 extending from the intended viewing point B is tangential to both the edges of the central regions 7,8 and optionally also the aperture, so that the regions and the apertures are seen by the eye as being equal in size.

Figure 13:
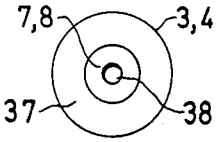
FIG. 13 illustrates a preferred embodiment of a grid disc.

FIG. 13 illustrates a grid disc 3,4 having a region 37 provided with grid lines, a transparent region 7,8 which is devoid of grid lines, and a central aperture 38.

The distance a between the grid discs 3,4 is smaller than the distance c between one end 9 of the housing 2, said end forming a viewing opening 10 through which the person using the sight views the target, and the grid disc 4 located nearest the viewing opening. The distance c exceeds the distance corresponding to the near point of a normal eye.

This enables the eye, which is intended to be placed immediately adjacent the sight means, to readily discern a clear interference pattern. Consequently, the distance c should not fall below 15 cm to 20 cm.

The grid discs are suitably produced from a clear transparent plastics material or from glass. The housing 2 is suitably made of metal, such as aluminium.

As indicated with the schematically illustrated eye in FIG. 1, when sighting the sight means onto a target the person using the sight will see the one grid disc 3 through the other grid disc 4, at the same time as the target is visible through the two central regions 7,8. Because the grid lines of the two grid discs 3,4 co-act with one another, the opaque lines 5 and the transparent interspaces 6 of the two grid discs will give rise to an interference pattern, a so-called moiré pattern. Such moiré patterns are illustrated in FIGS. 7–12.

The moiré pattern obtained is dependent on the graduation of the grids 3,4, i.e. the number of opaque lines 5 per unit of length at right angles to the lines 5.

The grid discs are constructed to present opaque lines 5 whose width exceeds the breadth of the transparent interspaces 6.

Although the width of the lines 5 can be selected to some extent, a width below 0.5 mm is preferred.

The grid discs are preferably graduated differently, i.e. so as to present a different number of opaque lines 5 in the radial direction.

In accordance with a preferred embodiment the grid discs 3,4 of respective grid assemblies are divided into two or more concentrical sections 11,12,13,14, the respective sections on a grid assembly having mutually different graduations. According to the embodiment illustrated in FIGS. 5 and 6, the sections comprise an inner part 11 and 13 respectively and an outer part 12 and 14 respectively, where the boundary line between the sections comprises a circle 15 and 16 respectively. The radius r of the circles 15 and 16 preferably corresponds from ½ to ¾ of the largest radius R of the grid. In the forwardly located grid 3 the radius may be r while in the rearwardly located grid 4 the radius may be somewhat smaller, namely r', due to the fact that the eye at the viewing point shall observe the radii r and r' as being equal.

In this embodiment the one grid disc 4 is provided with a finer graduation, i.e. the number of opaque lines 5 per unit length at right angles to the lines 5 in the inner section 11 is greater than the number of lines in the outer section 12 and the other grid disc 3 has the same graduation in its inner section 13 as the outer section 12 of said one grid disc 4 and the same graduation in its outer section 14 as in the inner section 11 of said one grid disc 4. The grid discs 3,4 are illustrated schematically in FIGS. 5 and 6, with schematically drawn opaque lines 5.

The width of the opaque lines 5 is preferably the same within each grid part of respective grid discs 3,4.

Figure 7:
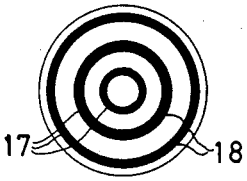
FIGS. 7–9 illustrate different interference patterns occurring when the sight means is sighted differently, the grids being those of the first embodiment.

When sighting through the sight means constructed in accordance with the aforegiven embodiment in a direction which coincides with the longitudinal axis of the sight means, i.e. in the direction of the centre line 19 of the grid units 3,4 the interference pattern illustrated schematically in FIG. 7 will be seen, this interference pattern comprising concentrically lying, broad dark rings 17 separated by light interspaces 18. The rings 17 are much wider than each indivudal opaque line 5. When the sight means is sighted so that the sighting line of the eye does not coincide with the direction of the centre line, asymmetric moiré patterns are formed, as illustrated in FIGS. 8 and 9, these patterns also including dark bands 22.

Figure 8:
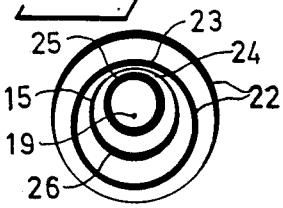
Figure 9:
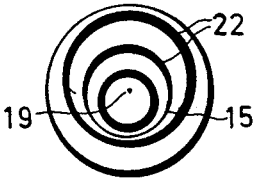

FIG. 8 illustrates schematically a moiré pattern formed with the aforementioned graduations when the sighting line of the eye lies beneath the centre line 19. The moiré pattern illustrated in FIG. 9 is formed when the sighting line of the eye lies above the centre line 19. When the sighting line of the eye forms an angle with the centre line 19, it is characteristic of the moiré pattern that the dark bands 23,24 will approach each other at a point 25 on the border defined by the circle 15 described by the radius r, and move away from each other at a diametrically opposed point 26 on the circle 15.

Thus, there is obtained through the aforesaid interference pattern information as to whether or not the centre line 19 is sighted onto the target viewed by the eye through the sight means. It will be understood that the length of the sight means may vary, a suitable length being 20–30 cm in the case of rifle sights and the like. It will also be understood that the length of the sight means and the distances a and c, together with the graduation of the grid discs influences the sensitivity or precision which can be obtained. Consequently, the aforesaid distances and graduations must be adapted to the purpose in question.

The diameter or diameters D1, D2 of the sight means can be varied with respect to the solid angle to be viewed, i.e. how much of the target surroundings the marksman desires to view. A suitable diameter is approximately 15% to 40% of the length of the sight means.

It shall also be possible to use a sight means in poor light conditions. Consequently, it is favourably that as much of the light entering the aperture 27 of the sight means as possible passes to the eye of the viewer. To this end the grid discs according to one preferred embodiment are constructed so that in the region provided with grid lines one disc has only one opaque line 5 more than the other grid disc. When the forwardly located grid disc 3 has one more opaque line than the rearwardly located grid disc 4 the interference pattern gives a deviation direction. When the rearwardly located disc 4 has one more opaque line than the forwardly located disc 3, the interference pattern gives a correction direction.

Figure 11:
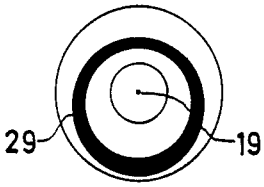
Figure 12:
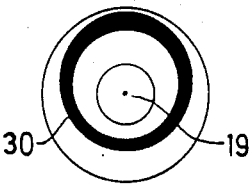

When the grid discs are constructed in accordance with such an embodiment, only one dark ring 28,39,30 is obtained as a result of the interference of the grid disc. FIGS. 10, 11 and 12 illustrate schematically the appearance of the interference pattern when viewing in directions corresponding to those described above with reference to the explanation of FIGS. 7,8 and 9, where the front grid disc 3 has one more opaque line than the rearwardly located disc 4.

Figure 5:
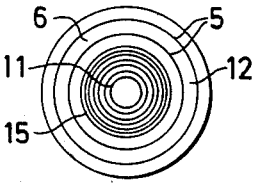
FIGS. 5 and 6 illustrate the two grid discs incorporated in the sight means in accordance with a further embodiment.
Figure 6:
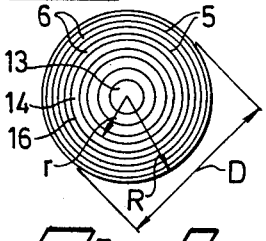

This embodiment enables more light to pass through the sight means than in the case of the embodiments illustrated in FIGS. 5 and 6.

As mentioned in the introduction, the interference pattern is discerned substantially by means of the indirect vision, while the yellow spot in the eye is sighted on the target. It is consequently preferred to arrange the grid discs so that only one interference ring 29–30 appears.

When designing the grid disc it must be remembered that the eye at the viewing point B discerns the graduation, of the rearwardly located grid disc 4, i.e. the number of opaque lines per unit length perpendicular to said lines, as being more sparse than the graduation of the forwardly located grid disc 3, since the forward disc 3 is located at a further distance from the eye.

Assume that the graduation of the rearward grid disc 4 is $d_1$ and the graduation of the forward grid disc 3 is $d_2$. When applying the designations used in FIG. 1, the distance x can be obtained from the expression $$\frac{d_2}{a+x} = \frac{d_1}{x}$$

The distance x gives the point, designated "O", at which the eye, when placed at point O, discerns the graduation in the two discs to be equal. This point "O" is preferably placed so that the distance x is smaller than the distance c. This means that the viewing point B cannot be chosen to fall forwardly or rearwardly of the point "O", which would mean that on one side of the point "O", the eye would observe the grid disc as though the forward disc had a more compact graduation than the rearward disc, while when located on the other side of the point "O" the eye would observe the grid as though the rear grid had a more compact graduation than the forward grid. In other words it can be said that on one side of the point "O" the interference pattern indicates a deviation direction and on the other side of said point a correction direction.

In accordance with one preferred embodiment there is located at the forward part of the sight means, i.e. at the aperture 27 of the tubular housing 2 remote from the viewing aperture 10, a sight holder 31 adapted to carry a sight 32, such as a bead, a wire-cross or the like. The sight 32 is aligned along the centre line 19, i.e. along a line extending through the centres of the grid discs 3,4.

The embodiment illustrated in FIG. 2 has a cross-wire 33 arranged in said central region 7,8.

Thus, there is provided by the present invention a highly effective sight means through which a relatively large part of a target surroundings can be viewed, while at the same time enabling the sight to be brought immediately onto the target with a high degree of accuracy.

This renders the sight means particularly suitable for use in those cases where the target shall be first localized rapidly through the sight means and whereafter the weapon or like object shall be sighted with great accuracy or the target shall be quickly localized, whereafter only a rough sighting shall take place, but where there is sometimes the need of sighting with high precision. The sight means is therefore particularly suited for use, for example, with so-called combirifles, and also with automatic rifles and the like.

In its simplest form the sight means may comprise solely the tubular housing and the grid discs. In such cases the aforesaid central region 7,8 can be made smaller and/or the forwardly located grid 3 provided with a cross-wire or some other marking in its central region 7.

When constructed as a disposable sight, the present sight means may comprise a plastics tube having two grid discs located therein. Such sight means can be made at very low costs, despite providing high precision sighting. Such sight means may be used, for example, for aligning landmines, as mentioned in the introduction.

In the embodiment illustrated in FIG. 1 the means for attaching the grid discs 3,4 have the form of shoulders 34,35 or grooves formed in the inner wall of the housing 2.

The grid discs and the sight holder 31 are firmly held relative to one another in the housing 2. The housing 2 as a whole, however, can be adjusted relative to the weapon. A device enabling such adjustment suitably comprises conventional attachments for adjusting the sight means in two perpendicular directions relative to the weapon.

The present invention can be modified in many ways. For example, the grid discs may have a shape other than round, for example square. The grid graduations may also be different to those given above.

The present invention is not therefore restricted to the aforedescribed embodiment, and modifications can be made within the scope of the following claims.

I claim:

1. A sight means, particularly for weapons and objects which are to be sighted onto a given point, comprising: two mutually spaced and mutually parallel grid discs (3, 4), each of which includes a transparent disc provided with concentrically lying opaque grid lines (5) separated by transparent interspaces (6); said grid discs (3, 4) being arranged in a tubular housing (2) with two ends; located in the centre of each of said discs (3, 4) is a central region (7, 8) which is devoid of opaque lines (5) and which has a size corresponding approximately to 1/5 to ½ of the disc diameter, through which regions the target is intended to be viewed; said two grid discs (3, 4) having opaque lines (5) whose widths exceed the width of the transparent interspaces (6); said grid discs (3, 4) having mutually different graduation, i.e. a mutually different number of opaque lines (5) per unit of length perpendicular to the opaque lines; a first distance (a) between the grid discs (3, 4) being dimensioned shorter than a second distance (c) between one end (9) of the housing (2), said one end defining a viewing aperture (10) for the person using the sight means, and the grid disc (4) located nearest the viewing aperture (10); and said second distance (c) having a dimension which exceeds the distance corresponding to the near point of a normal eye adjacent the viewing aperture.

2. A sight means according to claim 1 characterized in that in the region provided with grid lines the one (3;4) of the grid discs has only one more opaque line (5) than the other (4;3) of said grid discs.

3. A sight means according to claim 1, characterized in that the region provided with grid lines of each of the grid discs (3,4) includes concentrical regions (11,12; 13,14) of different graduation.

4. A sight means according to claim 3, characterized in that one (4) of the grid discs is provided with a grid of finer graduation (11) inwardly of and coarser graduation (12) outwardly of a given radius (r), while the other (3) of the grid discs is provided with a grid of coarser graduation (13) inwardly of and finer graduation (14) outwardly of a corresonding radius (r').

5. A sight means according to claim 1,
characterized in that the central region (7,8) is circular.

6. A sight means according to claim 1,
characterized in that each of the grid discs (3,4) has a central transparent region (7,8) which is devoid of opaque lines, and in which a central aperture (38) is provided.

7. A sight means according to claim 1,
characterized by a sight holder (31) firmly mounted relative to the grid discs (3,4) and adapted to carry a sight, such as a postbead, cross-wire etc., such that the sight lies along a line extending through the centres of the grid discs (3,4).

8. A sight means according to claim 1, wherein said central regions (7, 8) each have a size such that the regions (7, 8) in respective grid discs are perceived by the eye as being of equal size when the eye of a viewer is placed at the sight viewing aperture (10) intended therefor.

9. A sight means according to claim 8, wherein said central regions (7, 8) are central apertures (38).

* * * * *